US005690284A

United States Patent [19]

Murray

[11] Patent Number: 5,690,284

[45] Date of Patent: Nov. 25, 1997

[54] METHOD AND APPARATUS FOR GRINDING

[75] Inventor: Alastair Scott Murray, Huntly, United Kingdom

[73] Assignee: QED International Limited, United Kingdom

[21] Appl. No.: 246,564

[22] Filed: May 20, 1994

Related U.S. Application Data

[63] Continuation of Ser. No. 923,925, filed as PCT/GB92/00047, Jan. 9, 1992, abandoned.

[30] Foreign Application Priority Data

Jan. 9, 1991 [GB] United Kingdom ..... 9100456

[51] Int. Cl.[6] ..... B02C 19/00

[52] U.S. Cl. ..... 241/41; 241/79.1; 241/275

[58] Field of Search ..... 241/20, 38, 275, 241/79.1, 23, 41

[56] References Cited

U.S. PATENT DOCUMENTS

| | | | |
|---|---|---|---|
| 2,012,694 | 8/1935 | Runyan | 241/275 |
| 2,309,036 | 1/1943 | Beardsley | 241/41 |
| 2,672,296 | 3/1954 | Venable | 241/41 |
| 3,224,686 | 12/1965 | Wallace, Jr. | 241/41 |
| 3,254,848 | 6/1966 | Stephanoff | 241/41 |
| 3,680,796 | 8/1972 | Galeano | 241/21 |
| 4,133,487 | 1/1979 | Lanier | 241/5 |
| 4,635,860 | 1/1987 | Kruyer | 241/23 |
| 4,641,787 | 2/1987 | Petersen et al. | 241/5 |
| 4,662,571 | 5/1987 | MacDonald et al. | 241/81 |
| 5,167,375 | 12/1992 | Datta | 241/46.02 |

FOREIGN PATENT DOCUMENTS

| | | |
|---|---|---|
| 1268242 | 3/1972 | United Kingdom . |
| 2120112 | 9/1982 | United Kingdom . |

*Primary Examiner*—John Husar
*Attorney, Agent, or Firm*—D. Peter Hochberg; Mark Kusner

[57] ABSTRACT

There is disclosed a method and apparatus for grinding. Based on a vertical shaft impactor, a method is disclosed which provides improved results by allowing materials to be ground in a wet form. The grinding apparatus includes supply lines (171, 172) and inlets (170, 187) which allow material to be supplied in such a form.

10 Claims, 5 Drawing Sheets

METHOD AND APPARATUS FOR GRINDING

This is a continuation of application Ser. No. 07/923,925 filed as PCT/GB92/00047 on Jan. 9, 1992, now abandoned.

This invention relates to a method and an apparatus for grinding, which may be used for grinding wet material.

There are a wide variety of situations in which it is necessary to grind materials, in order to reduce particle sizes. One type of grinding apparatus is a vertical shaft impactor, or VSI, such as a BARMAC ROTOPACTOR (Trademark) vertical shaft impactor, or a BARMAC DUOPACTOR (Trademark) vertical shaft impactor. These machines have a rotor, which rotates about a vertical axis, and which causes the feed material to be flung outwardly towards an impact surface. Vertical shaft impactors with two inlets are also known, in which feed material supplied to the second inlet cascades past the rotor through the material being flung outwardly from the rotor.

The machines described above are used extensively for autogenous grinding of dry feed material such as rocks and ores, but there are many situations in which the feed material is not dry, and it has previously been thought that such materials are unsuitable for grinding in this way. Moreover, it has been found that there may be surprising advantages if the feed materials are processed in a wet condition. The present invention therefore seeks to provide a method and an apparatus which allow grinding to be carried out in a wet state. Furthermore by grinding minerals or materials in the presence of solvents or chemical reagents it may be possible to clean environmentally noxious materials or release bound minerals from their parent materials in a more efficient and economical manner.

Embodiments of the present invention further seek to provide a method and apparatus for the treatment of oil- or water-based cuttings, such as the by-products of drilling for oil, gas and other subterranean fluids. Other materials associated with these spheres of activity may be contaminated with oil or other materials used in drilling operations. The cuttings may also be in the form of Low Specific Activity scales, which are produced during some drilling activities.

According to a first aspect of the present invention, there is provided a vertical shaft impactor grinding apparatus, comprising:

a feed hopper defining a first inlet for feed material;

a rotor;

means for connecting the feed hopper directly to the rotor such that inlet feed material is flung outwardly by the rotor into a grinding region;

a second inlet for feed material in a liquid form, the second inlet being arranged such that feed material supplied therethrough is passed to the grinding region without entering the rotor.

According to a second aspect of the present invention, there is provided a grinding apparatus, comprising:

a vertical shaft impactor with a rotor and with at least one inlet for feed material, and an outlet for ground material;

a classifier, for separating oversized ground material from material removed from the impactor;

a first supply line for transporting ground material from the outlet to the classifier; and a second supply line for returning separated oversized ground material to the impactor, wherein the first and second supply lines are suitable for transporting ground material within a liquid.

According to a third aspect of the present invention there is provided a process for grinding a material in a vertical shaft impactor which has a rotor, the process comprising the steps of:

grinding feed materials in the impactor;

removing the ground material from the impactor;

classifying the removed ground material by separating oversized ground material; and returning the oversized ground material to the impactor, in the form of a slurry comprising solid particles in a liquid, or in a semi-dried form.

According to a fourth aspect of the present invention, there is provided a method of treatment of glutinous cuttings, the method comprising the step of grinding the cuttings in a vertical shaft impactor to form a relatively dry product with a reduced particle size.

According to a fifth aspect of the present invention, there is provided a vertical shaft impactor grinding apparatus including a rotor, the apparatus including means for preventing the build up of ground glutinous material in the region of the rotor.

Preferably, the apparatus includes at least one inlet for compressed air.

References herein to "classifying" a material or to a "classifier" include any method or device for separating particles on the basis of their sizes, including the use of a vibrating screen.

For a better understanding of the present invention, and to show how it may be brought into effect, reference will now be made, by way of example, to the accompanying drawings in which.

Figure 1:
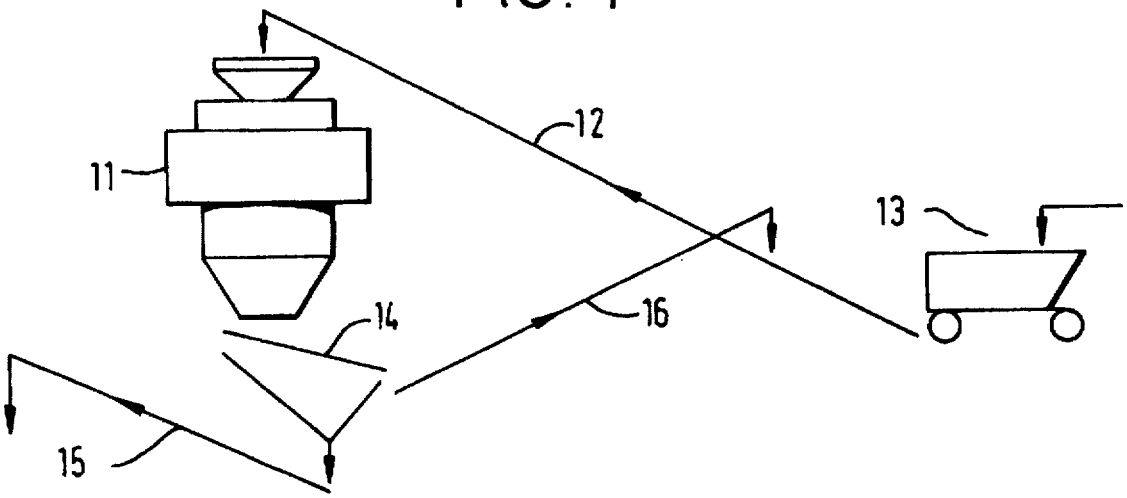
FIG. 1 is a schematic diagram illustrating a largely conventional grinding apparatus.

FIG. 1 shows a grinding apparatus based on one type of vertical shaft impactor or VSI 11. The VSI 11 has an internal rotor, and feed material which enters the device is flung outwardly towards an impact surface at which crushing and grinding takes place. Feed material, such as rock or ore, is supplied to the VSI 11 along a suitable conveying device 12 from a feed hopper 13, or other source of supply.

Ground material from the VSI 11 leaves at the bottom of the device and falls on to a screen 14, which acts as a classifier. Fine material passes through the screen and is collected on a conveyor 15, by which it can be transported for further processing or disposal. Oversized particles do not pass through the screen 14, and are returned on a conveyor 16 to the conveyor 12, by which they are returned to the inlet of the VSI 11 so that they can be further reduced.

This system is suitable for dry or semi dry grinding of a large number of materials. However, there are other grinding applications in which this system may not be appropriate. For example, there are situations where it may be desirable to carry out grinding in the presence of large quantities of water, or other fluids. One example of this is in the grinding of Low Specific Activity (LSA) scales. These are naturally occurring rock substances which emit low level radioactivity. The scales are produced by the agglomeration of particles which are produced, for example during drilling for oil through certain rock formations, such as those occurring in the North Sea. The levels of radioactivity are low enough that, if the scales are ground to a small particle size, they can be safely disposed of. However, the grinding of the scales is difficult, because if this were to be done dry there would be a danger that fine particles of dust, with unacceptable levels of radioactivity, would be produced, and may become airborne. However, the grinding of LSA scales in a wet state ensures that this dust is not produced. The present invention discloses a process for grinding these materials, and any other materials which are more easily handled or processed in a wet form, in a way that allows the resulting particle sizes to be very small.

Figure 2:
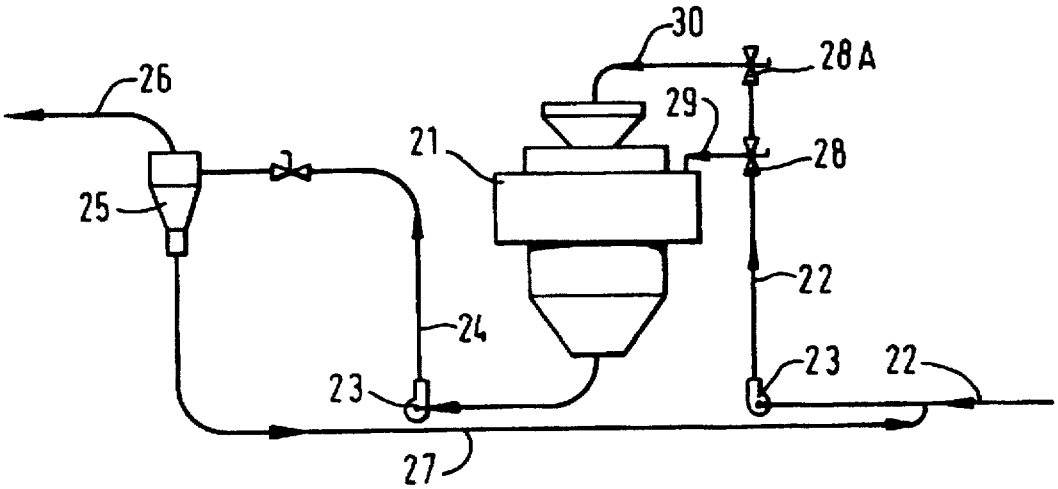
FIG. 2 is a schematic diagram illustrating an apparatus in accordance with a first embodiment of the present invention.

FIG. 2 shows a system in accordance with the present invention. Again, the apparatus is built around a VSI 21, for example a Barmac Duopactor 4800 with suitable modifications. The feed material is supplied to the VSI 21 wet along a supply line 22 via a pump 23. Ground material is fed from the VSI 21 along outlet line 24 to a hydrocyclone classifier 25. Fine particles are passed along outlet 26 for disposal or further processing, while oversized particles and liquid return along feed line 27 into the supply line 22. Valves 28, 28*a* are provided in the supply line 22, so as to control flows to inlet lines 29, 30. Recycled slurry and new material passing along the line 30 enters the rotor feed tube of the VSI 21 in the normal way. Recycled slurry and new material passing along line 29 can also be introduced through the top of the VSI 21 to a cascade device in more than one position, and it thus cascades past the rotor. Adjustment of the valves 28 and 28A allows alteration of the relative rates of flow along the lines 29 and 30.

Figure 4:
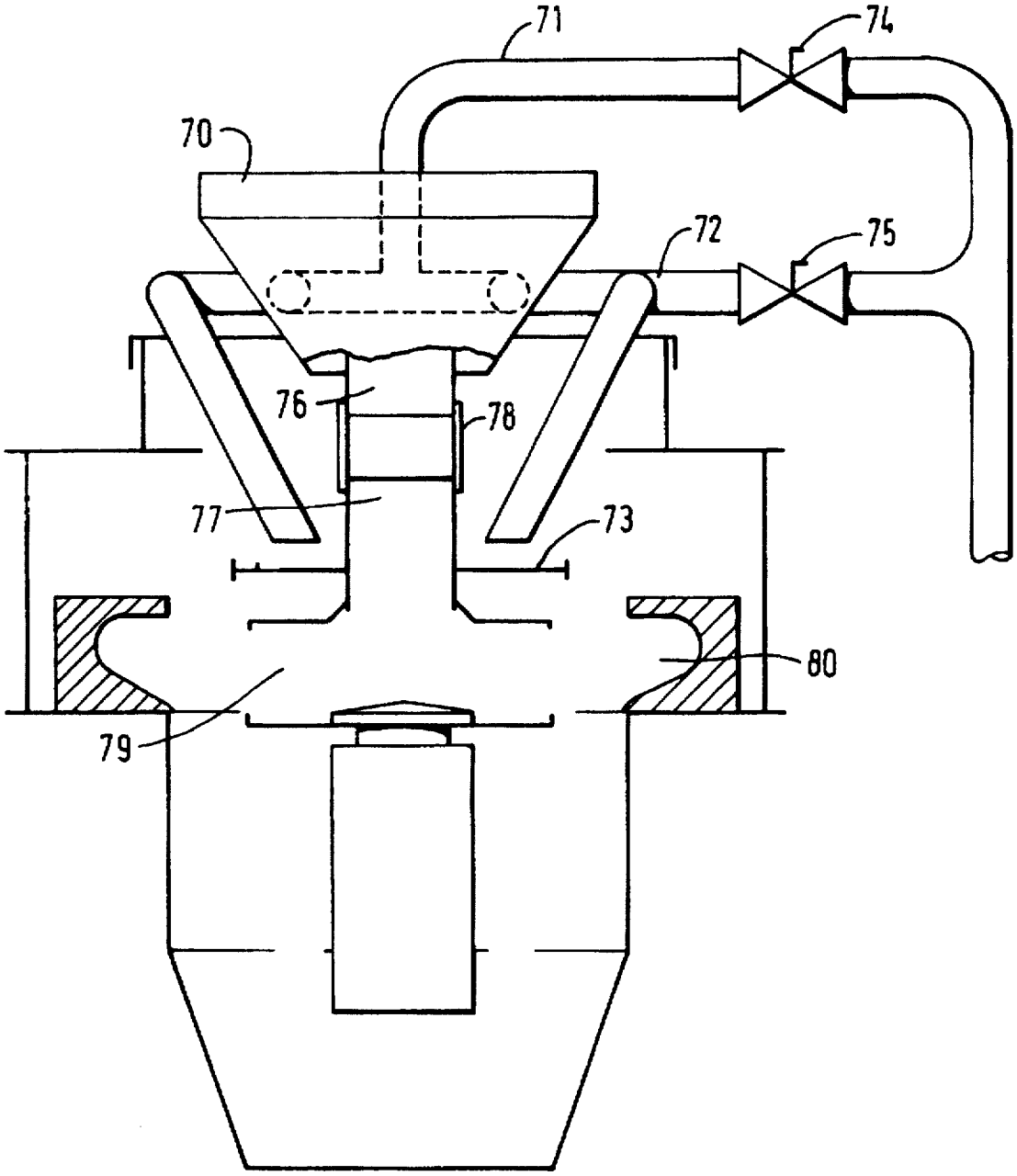
FIG. 4 is a schematic cross-section through a vertical shaft impactor in accordance with another aspect of the invention.

FIG. 4 is a schematic diagram showing a vertical shaft impactor, specifically a specially adapted 4800 Barmac Duopactor (Trade Mark), which may be used in the apparatus in accordance with the invention. The VSI has a first inlet 70 which receives solid feed material together with a controlled amount of liquid which enters via manifold 71; additional liquids are introduced by manifolds 72 which deposit the liquids onto a cascade plate 73. The proportional distribution of these liquids between manifolds 71 and 72 is controlled by valves 74 and 75. The introduced liquids may also carry solid particles which may be additional feed material or the oversize materials as rejected by a classifying device installed within the further processing system.

The valves can be controlled such that, for a given energy input to the rotor of the impactor, desired results are achieved in terms of material throughput and resulting particle size distributions. It is advantageous to return some of the oversized material to the rotor because the added liquid assists in the grinding process. However, energy is saved if most of the oversized material is passed to the cascade inlet and does not enter the rotor. This is because, on average, the "oversized" ground material will have smaller particle sizes than the raw feed material. Greater energy efficiency can be obtained by passing the raw feed material to the rotor, since it is this material which requires more effort to reduce its average particle size.

The solids/liquid mix which enters the first inlet 70 passes through control tube 76 and the rotor feed tube 77 which are connected together by a sleeve 78 and which direct the solids/liquid feed material into the rotor 79. From the rotor 79 the feed mix is flung outwardly into the grinding area 80. The grinding area contains a bed of the solid material which is being ground, but may alternatively be filled with special wear-resistant steel anvils or similar materials.

At the same time, the liquid being fed onto the cascade plate 73 from the manifolds 72 cascades downwards into the flow of material which is being flung outwardly from the rotor 79.

Figure 5:
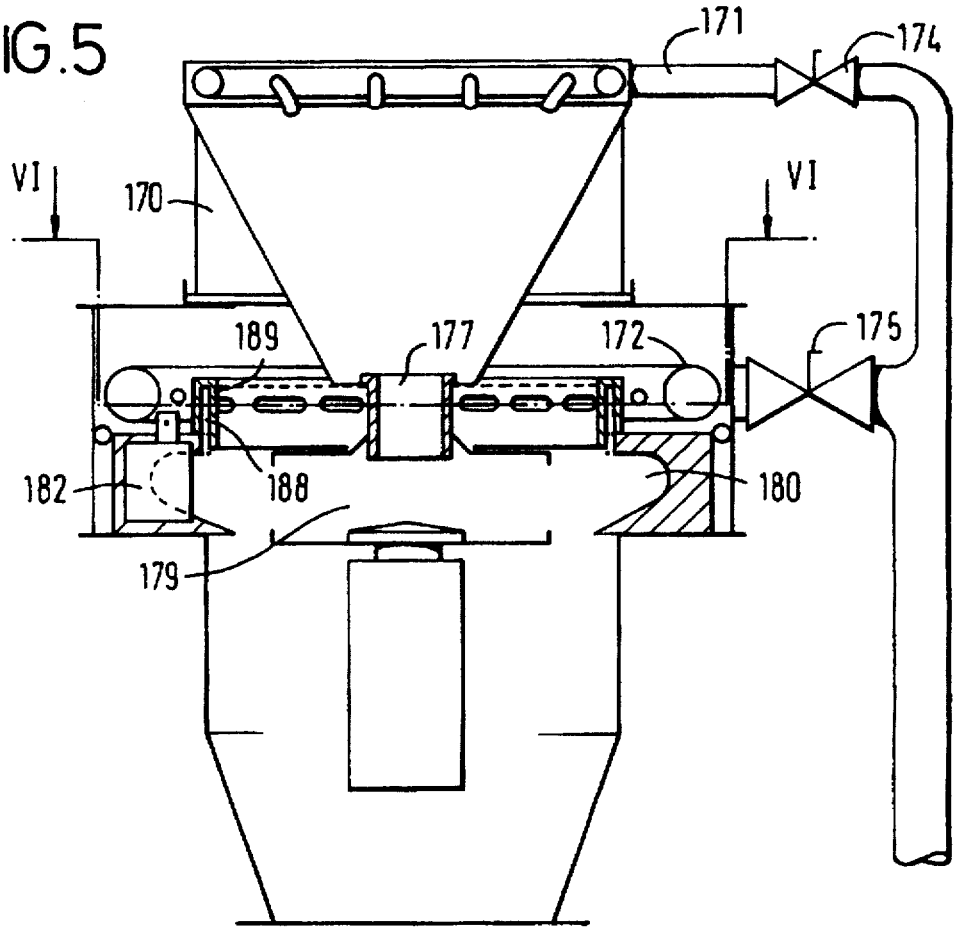
FIG. 5 is a cross-section through a vertical shaft impactor in accordance with an alternative embodiment of the other aspect of the invention.

FIG. 5 shows an alternative embodiment of the grinding apparatus which may be used in the system shown in FIG. 2. Again, the apparatus is in the form of a specially modified VSI based on part of a 4800 Barmac Duopactor.

The VSI has a first inlet 170 to receive solid or semi-solid feed material together with a controlled amount of liquid which enters via manifold 171 and is controlled by valve 174; additional liquids are introduced by a manifold 172 which is controlled by valve 175.

Figure 6:
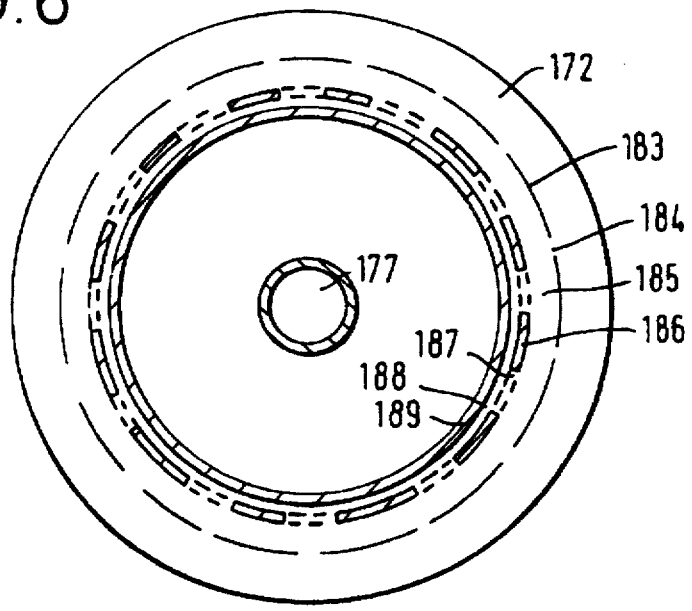
FIG. 6 is a partial section through the device shown in FIG. 5, along line VI—VI.

As also shown in FIG. 6, which is a partial cross-section through the apparatus shown in FIG. 5, the liquid is introduced by a manifold 172 which is in the form of a ring. The inner wall 183 of the manifold 172 is perforated, and the liquid passes through the perforations 184 into an annular inner region 185. Again, the inner wall 186 of the annular region 185 is perforated, and liquid is forced through the perforations 187 into a thin annular region 188 having a small radial dimension, the inner wall 189 of this region being solid. From the thin annular region 188, the liquid, and any entrained solid particles, are able to fall vertically downwards into the grinding region 180. It is advantageous that the material enters the grinding region moving vertically and with no radial velocity, or only a small radial velocity, as this improves the grinding which is achieved. At the same time, material introduced through the first inlet 170 and the tube 177 which passes through the centre of the manifold 172, is being thrown outwardly from the rotor 179. Thus, in the grinding region 180 there are high autogenous attrition forces, which result in highly effective grinding of the material.

In addition there are located in the grinding area special self-adjusting shear plates 182 which enhance the grinding action especially of the larger material particles.

The shear plates take the form of flat plates which are mounted in the grinding region. The plates are pivotally mounted such that, as material exits the rotor, the plates are deflected so that their inner edges act as shearing edges on the material exiting the rotor. These edges are advantageously protected by wear resistant material. In the illustrated embodiment, the shear plates are suspended on bars which are located approximately one third of the way along the plate, such that the plates are easily replaceable. Any desired number of such shear plates can be chosen to be circumferentially spaced around the rotor as required. As an alternative, the shear plates may be replaced by a grinding ring, or breaker ring, in the form of a continuous ring which may be set into the grinding region, either in segments or in one piece, and which has a sharp corrugated surface to improve the initial breakage of large material exiting the rotor.

Further, or as an alternative to the shear plates or grinding ring, the efficiency of the grinding process may be improved by the addition of heavy massing agents, which can assist in the grinding process without themselves being broken down very quickly so that they are rejected by any classifying device which is used and thus can be recirculated around the system. These massing agents are made of a material which is preferably several times as dense as the material being ground, and is preferably highly ductile, so that they have high kinetic energies during the grinding process and hence enhance the reduction of the material to be ground, but are able to withstand the high forces exerted on them for a useful period of time. For example, the massing agents may be steel ball bearings, steel discs or other suitable steel objects. Of course, any material chosen in this way must also be selected so that it does not contaminate the final ground product.

Figure 3:
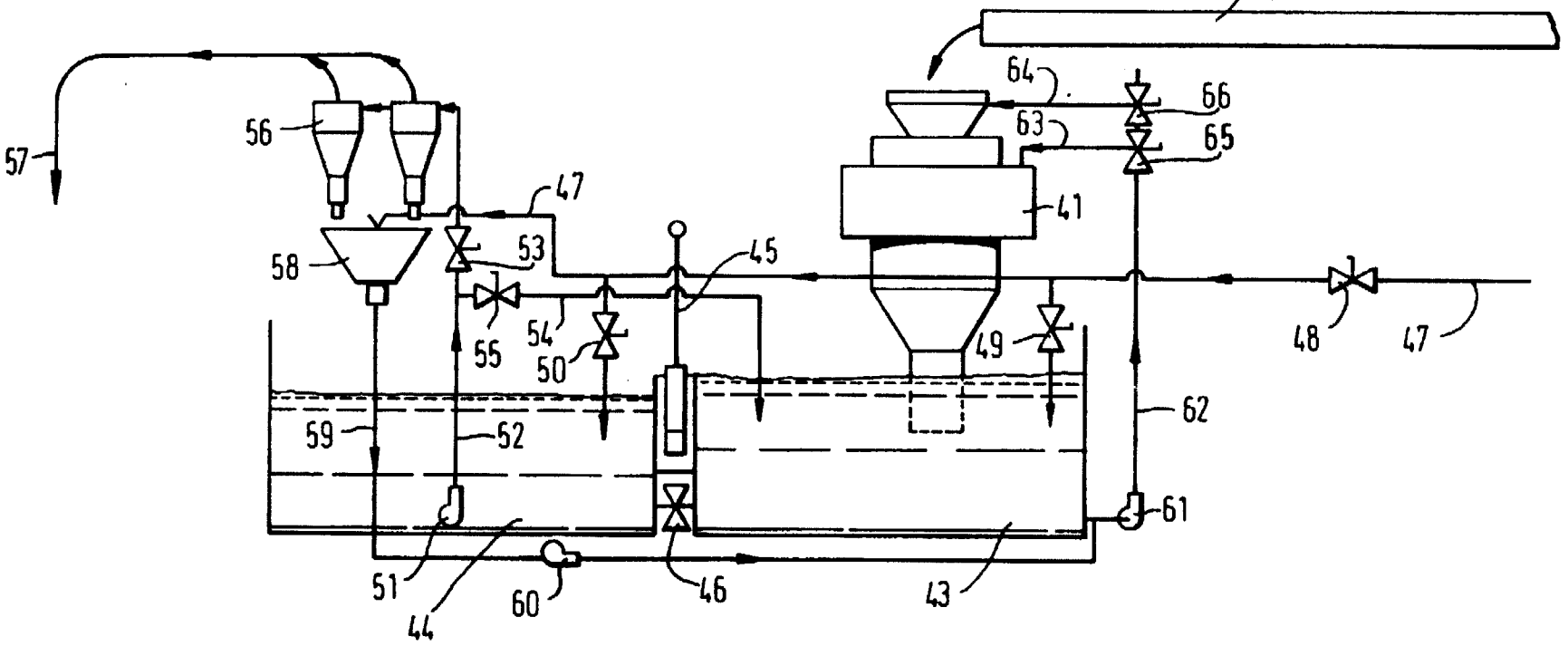
FIG. 3 is a schematic diagram illustrating an apparatus in accordance with one aspect of the present invention.

FIG. 3 shows an alternative embodiment of the invention, for use in a hybrid process in which the feed material is originally fairly dry, but may for example be oil- or water-based cuttings, which are relatively glutinous. It has surprisingly been found that wet grinding of these cuttings, in apparatus according to the present invention, has remarkably beneficial effects.

The apparatus includes a VSI 41, to which the feed material is supplied along a controlled conveying device 42. The VSI 41 is preferably as illustrated in FIG. 4 or FIGS. 5 and 6 of the drawings. Ground material leaves the VSI and enters a liquid-filled tank 43 which is designated the coarse slurry tank. Adjacent to this tank 43 is a second tank 44 designated the fine slurry tank. These tanks are connected by an adjustable weir gate 45 and a balancing line including a valve 46. Liquid in these tanks 43 and 44 is introduced from a flow line 47, and the flow is controlled by valves 48, 49 and 50.

Ground material leaves the VSI and enters the coarse slurry tank 43. Some settlement of the material takes place in this tank, and the finer fraction of the slurry passes to tank 44 via the weir gate, the height of which is adjusted to give the required fineness and flow.

The fine slurry is removed from tank 44 by a pump 51 along a flow line 52 to hydrocyclones 56. It will be appreciated that washing screens or other classifying devices may be used. The flow to these classifying devices in the flow line 52 is controlled by a valve 53. There is also a bypass system such that excess fine slurry can be returned to the coarse slurry tank 43 via line 54 and control valve 55, if desired.

The fine fraction of the slurry, having been classified to the desired specific gravity or particle size, is passed to a storage facility by line 57 for further process applications.

The coarse fraction of material leaving the classifying device 56 passes to a catchment hopper 58 where it can be flushed by liquid from line 47 and then passed to line 59 where by means of pump 60 it is returned to the inlet side of pump 61.

Pump 61 is mounted adjacent to the coarse slurry tank 43 and takes coarse slurry from the tank 43 plus classifier oversize from the line 59 and passes this material to the VSI 41 along flow line 62.

Flow line 62 introduces the coarse slurry to the VSI 41 in two positions along flow line 63 and 64. The flow of slurry to these two lines is controlled by valves 65 and 66. To maximise the efficiency of the grinding process, it is preferable if the majority of the slurry is supplied to the cascade input of the VSI 41 along flow line 63, while raw feed material is supplied to the VSI with only sufficient liquid to prevent the build up of material in the feed hopper. This is because the returned material contained in the slurry will, on average, have smaller particle sizes than the raw feed material, and hence greater efficiency can be achieved by preferentially using the input energy, which is supplied by means of the rotor of the VSI, in the grinding of the raw feed material.

Thus, it is possible both to introduce coarse slurry along with the primary feed material but also to arrange to pass coarse slurry to the cascade device as previously discussed. In this manner it has been found that grinding of mineral material can be accomplished in a liquid environment where densities, particle distributions or chemical characteristics can be influenced and controlled.

When drilling for oil or gas, cuttings or chippings may be produced which are impregnated by oil which has been used as a lubricant to aid the drilling process. Oil-impregnated chippings such as these are in the form of a sticky glutinous material, which cannot easily be ground and are extremely difficult to process conventionally. However, if these particles could be ground, there would be the advantage that the oil may be more easily removable from the resulting powder. In an output ground material in which there is a large proportion of fine particles, these fine particles have, in total, a very much greater surface area than the original chippings, and thus appear relatively dry, as they are better able to absorb liquids. Thus, these particles can be handled more easily than the original chippings. For example, it is possible to "boil" off any oil or other liquid contaminants in an oven or drier. These liquids can then be recondensed and disposed of as required, while the solids, forming the greater part of the original waste material, are now clean and can be disposed of more easily.

If it is possible to use this method to produce a dry product of constant fineness, this may also be a useful step even if the aim of the process is to produce a slurry as the final material. This is because, given a dry product of constant fineness, it is possible simply to add a given amount of liquid to produce a product with a required specific gravity and viscosity, or other desired chemical or physical properties, in a controlled manner.

The dry product may alternatively be used as a soil additive or stabiliser, or as the raw feed material for producing, after additional processing steps, lightweight aggregates for the construction industry, or possibly industrial fillers.

The method according to the fourth aspect of the invention can use a modified Barmac Rotopactor or Duopactor (Trade Marks). These machines are well known to people skilled in the art, and it will be appreciated that other suitable vertical shaft impactors may also be used when suitably modified.

Figure 7:
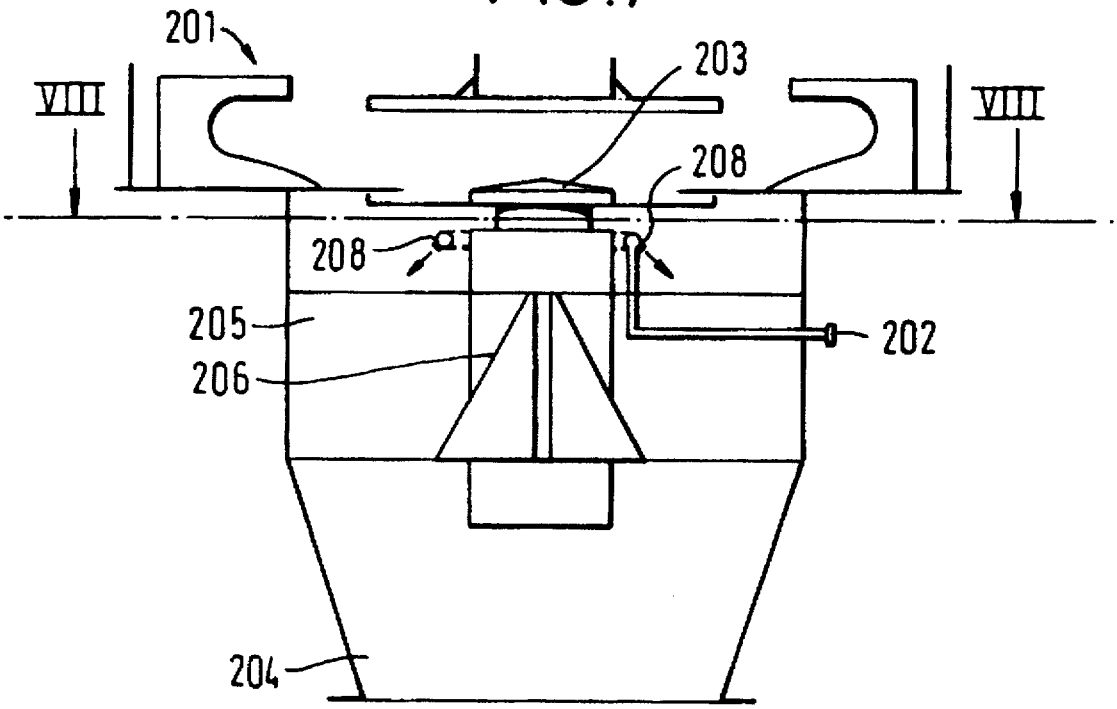
FIG. 7 is a partial cross-section through a vertical shaft impactor in accordance with a fifth aspect of the invention, for use in a method in accordance with the fourth aspect of the invention.
Figure 8:
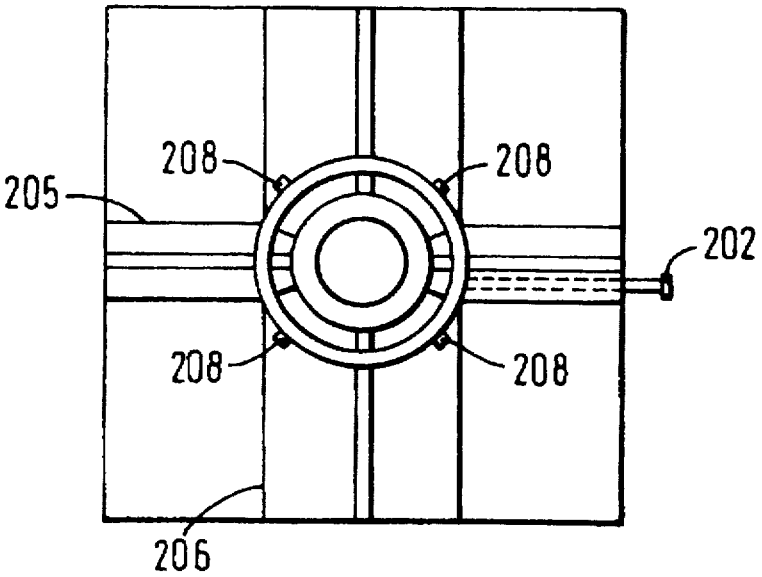
FIG. 8 is a cross-section through the device shown in FIG. 7, on line VIII—VIII.

FIG. 7 shows a vertical shaft impactor in accordance with the fifth aspect of the invention, for use in the method according to the fourth aspect of the invention and FIG. 8 is a cross-sectional view on line VIII—VIII. The vertical shaft impactor 201 is largely conventional, but has additional spill plates e.g. 205, 206 within the machine to ensure that there are no ledges on which ground material can build up and then come into contact with the rotor, which would in effect block or choke the machine. In addition, the vertical shaft impactor 201 is preferably provided with an inlet 202 for compressed air in the regions below the rotor 203 and around the discharge ports 204. Air from the inlet 202 enters a manifold 207. From the manifold 207, the air is fed into the machine via a plurality of air jets 208, as shown by arrows A. The introduction of compressed air ensures that the ground material is kept moving by, in effect, using the air to fluidise it. This is particularly advantageous where the oil content of the material is high or the ground material is sticky or glutinous because of other liquids which may be present.

Oil-based drill cuttings, produced by drilling, are fed into the inlet of the vertical shaft impactor and ground. The design of the internal parts of the vertical shaft impactor, together with the supply of compressed air to the machine, ensures that the ground particles do not tend to build up within the machine. It will be appreciated that the same process can be applied to the grinding of water-based drill cuttings or any other glutinous cuttings with similar properties.

Glutinous contaminated cuttings, such as oil-based cuttings, are difficult to handle, and it has previously been found that these materials are difficult to grind. Moreover, it has previously been thought that the known vertical shaft impactor machines were only able to grind materials with moisture contents no greater than 8–10%. However, it has now surprisingly been found that it is possible successfully to grind oil-based cuttings with liquid contents in the region of 15% or more, by feeding these to a modified vertical shaft impactor without added liquid. Thus, it has now been found that the grinding of these materials in a vertical shaft impactor can produce a material with reduced particle size, which is partially dried during the reduction process. As described above, this dry material can be handled more easily, for example by "boiling" off the oil or other liquid contaminant, or dissolving them in appropriate solvents.

I claim:

1. Grinding apparatus for reducing sizes of mineral particles entrained in a liquid medium, the apparatus comprising:

a vertical shaft impactor having:

a rotor, said rotor being rotatable about a predetermined substantially vertical axis and having an outer peripheral edge;

a first material inlet aligned substantially along said predetermined axis of said rotor for supplying feed material directly to said rotor;

an impact bed located radially outwardly of said rotor, said impact bed being spaced from the peripheral edge of said rotor and defining a grinding region therebetween, said impact bed being disposed such that feed material supplied to said rotor from said first inlet is flung outwardly against said impact bed; and a second material inlet for introducing feed material in the form of solid particles in a liquid suspension, said second material inlet being positioned above said grinding region wherein material introduced through said second material inlet is fed substantially vertically into said grinding region without entering said rotor such that said solid particles in a liquid suspension intersect said feed material flung from said rotor at generally right angles thereto.

2. Grinding apparatus as claimed in claim 1, further comprising:

means for supplying raw feed material in liquid suspension to said first material inlet.

3. Grinding apparatus for reducing sizes of mineral particles entrained in a liquid medium, the apparatus comprising:

a vertical shaft impactor having:

a rotor, said rotor being rotatable about a predetermined substantially vertical axis and having an outer peripheral edge;

a first material inlet aligned substantially along said predetermined axis of said rotor for supplying feed material directly to said rotor;

an impact bed located radially outwardly of said rotor, said impact bed being spaced from the peripheral edge of said rotor and defining a grinding region therebetween, said impact bed being disposed such that feed material supplied to said rotor from said first inlet is flung outwardly against said impact bed; and a second material inlet for introducing feed material in the form of solid particles in a liquid suspension, said second material inlet being positioned above said grinding region wherein material introduced through said second material inlet is fed into said grinding region without entering said rotor such that said solid particles in a liquid suspension intersect said feed material flung from said rotor at generally right angles thereto, wherein said second material inlet comprises a plurality of pipes for directing said suspension on to a cascade plate located above the rotor such that said suspension cascades into the grinding region.

4. Grinding apparatus for reducing mineral particle sizes, the apparatus comprising a vertical shaft impactor, the vertical shaft impactor having:

at least one inlet for feed material in the form of solid particles in a liquid suspension;

a rotor rotatable about a substantially vertical axis and having an outer peripheral edge, said rotor disposed relative to said at least one inlet to receive a first portion of said feed material therefrom;

an impact bed located radially outwardly of said rotor, said impact bed being spaced from the peripheral edge of said rotor and defining a grinding region therebetween, said impact bed being disposed such that said first portion of said feed material received from said at least one inlet is flung outwardly towards said impact bed; and rotor bypass means positioned to receive a second portion of said feed material, said rotor bypass means comprising means defining a first annular region, and means defining a second annular region, said first annular region being located radially outwardly of said second annular region, and said second annular region being separated from but in communication with said first annular region such that said second portion of said feed material can flow from said first annular region to said second annular region, and said second annular region being located above said grinding region and having an open lower portion, such that said second portion of said feed material falls from said second annular region substantially vertically into the path of material being flung outwardly from said rotor.

5. Grinding apparatus as claimed in claim 4, wherein said open lower portion of said second annular region of said rotor bypass means has a small extent in a radial direction.

6. Grinding apparatus as claimed in claim 4, having a first inlet to which said rotor is connected, and a separate second inlet from which said rotor bypass means receives feed material.

7. Grinding apparatus for reducing sizes of mineral particles entrained in a liquid medium, comprising:

a vertical shaft impactor adapted to receive solids in a liquid suspension, the vertical shaft impactor having:

a first inlet for feed material;

a second inlet for feed material, said second inlet being separated from said first inlet;

a rotor rotatable about a fixed axis, said rotor having an outer peripheral edge and being positioned to receive feed material from said first inlet;

an impact bed located radially outwardly of said rotor, said impact bed being spaced from the peripheral edge of said rotor and defining a grinding region therebetween, said impact bed being disposed such that feed material received from said first inlet is flung outwardly against said impact bed; and distribution means for receiving feed material from said second inlet, said distribution means being located above said grinding region such that feed material received thereby falls into the flow of material flung outwardly from said rotor;

said grinding apparatus further comprising:

means for supplying raw feed material in liquid suspension to said first inlet of said vertical shaft impactor;

means for classifying ground material from said vertical shaft impactor into fine particles and oversized particles;

means for returning said oversized particles to said first and second inlets of said vertical shaft impactor; and means controllable by an operator of the apparatus for varying the relative proportions of said oversized particles returned to said first and second inlets.

8. Apparatus as claimed in claim 7, further comprising a liquid-containing tank for receiving ground material from said vertical shaft impactor, the tank including means for separating the ground material into a coarse fraction with relatively large particle sizes, and a fine fraction with relatively small particle sizes, means for returning the coarse fraction to said vertical shaft impactor and the fine fraction to a classifying device, said classifying device separating the fine fraction into a first fraction containing particles of desired sizes, and a second fraction containing oversized particles which are returned to said vertical shaft impactor.

9. Apparatus as claimed in claim 8, wherein the liquid-containing tank is provided with an adjustable weir device, said weir device directing the fine fraction of the ground material to a second tank, the second tank having a pump to supply material to the classifying device.

10. Apparatus as claimed in claim 8, wherein the first fraction of the ground material is relatively dry, and wherein the apparatus comprises means for adding a calculated amount of liquid to this ground material to produce a slurry having desired viscosity, specific gravity or chemical characteristics.

* * * * *